United States Patent [19]

Moore

[11] Patent Number: 4,504,005

[45] Date of Patent: Mar. 12, 1985

[54] FILM PROCESSOR TRANSPORT ROLLER END PLUG

[75] Inventor: Dwane L. Moore, Wichita, Kans.

[73] Assignee: Kreonite, Inc., Wichita, Kans.

[21] Appl. No.: 421,297

[22] Filed: Sep. 22, 1982

[51] Int. Cl.[3] ..... B65H 17/20; B65D 39/04; G03D 3/08

[52] U.S. Cl. ..... 226/190; 215/364; 354/320

[58] Field of Search ..... 277/33, 36, 37, 142, 277/212 C, 168, 171, 179, 190, 191, 192; 29/110, 123, 129, 119; 215/364, 360, 361; 354/297, 319, 320, 321, 322; 226/190, 194

[56] References Cited

U.S. PATENT DOCUMENTS

| | | | |
|---|---|---|---|
| 649,145 | 5/1900 | Thrush et al. | 29/119 |
| 902,736 | 11/1908 | Jennings | 29/123 X |
| 2,623,798 | 12/1952 | Skinner | 277/212 |
| 2,770,510 | 11/1956 | Collins | 277/171 X |
| 2,855,003 | 10/1958 | Thaxton | 277/192 X |
| 3,317,071 | 5/1967 | Teeter | 215/360 |
| 3,532,048 | 10/1970 | Hope | 354/320 X |
| 3,591,278 | 7/1971 | Limberger | 354/297 X |
| 4,248,392 | 2/1981 | Parry | 242/96 |

FOREIGN PATENT DOCUMENTS

| | | | |
|---|---|---|---|
| 1102582 | 10/1955 | France | 277/190 |

*Primary Examiner*—Stuart S. Levy
*Assistant Examiner*—Leo J. Peters
*Attorney, Agent, or Firm*—Edwin H. Crabtree

[57] ABSTRACT

A film processor transport roller end plug for providing a liquid seal in a hollow film processor roller. The end plug characterized by having a tightened "O" ring inside the roller to provide a liquid seal and to retain the end plug therein.

3 Claims, 4 Drawing Figures

FILM PROCESSOR TRANSPORT ROLLER END PLUG

BACKGROUND OF THE INVENTION

This invention relates to an end plug for receipt inside a hollow cylindrical surface and more particularly but not by way of limitation to a film processor transport roller end plug for providing a liquid seal in a hollow film processor roller.

Heretofore, in the film processing industry both plastic and stainless steel rollers were used for transporting film or paper through a film processor. The rollers included end plugs which were, in the case of a plastic roller, bonded inside the hollow roller. Stainless steel plugs were also used with stainless steel rollers and were welded in place. When either the plastic or stainless steel roller was broken, the end plugs were not removable and therefore were discarded with the broken roller. Also, the rollers required grinding, boring and straigntening and the end plugs required machining or molding so proper tolerances could be obtained for either cementing or welding the plugs inside one end of the roller.

The subject liquid tight roller end plug eliminates the above mentioned problems and provides the unique structure and advantages as described herein.

SUMMARY OF THE INVENTION

The subject film processor transport roller end plug eliminates the cement bonding or welding of plastic roller or stainless steel end plugs inside one end of a process roller. Further, the subject end plug eliminates grinding, boring and straightening of plastic and stainless steel rollers so proper tolerances can be met as required in the past. Also the subject molded end plug eliminates machining of stainless steel plugs.

The end plug is removable and may be reused when a roller is broken. The plug is easy to install and can be quickly removed. Further, the end plug requires no machined parts.

While the end plug is discussed as part of a film processor transport roller the plug can be used equally well with rollers used in processing print paper.

The film processor transport roller end plug for providing a liquid seal in a hollow film processor roller includes an annular hollow plug housing having a first end portion and a second end portion. The first end portion has an outer circumference adapted for engaging the inner circumference of the processor roller and receipt therein. An annular core is part of the end plug and has one end received in the first end portion of the plug housing. The other end of the core has a cam surface therearound. An "O" ring is received around the cam surface of the core. When a threaded screw is received through the plug housing and engages a threaded nut inside the core and tightened therein, the edge of the first end portion of the housing engages the "O" ring and compresses the "O" ring against the cam surface and against the inner circumference of the roller thereby providing a liquid seal and retains the plug in the end of the processor roller.

The advantages and objects of the invention will become evident from the following detailed description of the drawings when read in conjunction with the accompanying drawings which illustrate preferred embodiments of the invention.

DETAILED DESCRIPTION OF THE DRAWINGS

Figure 1:
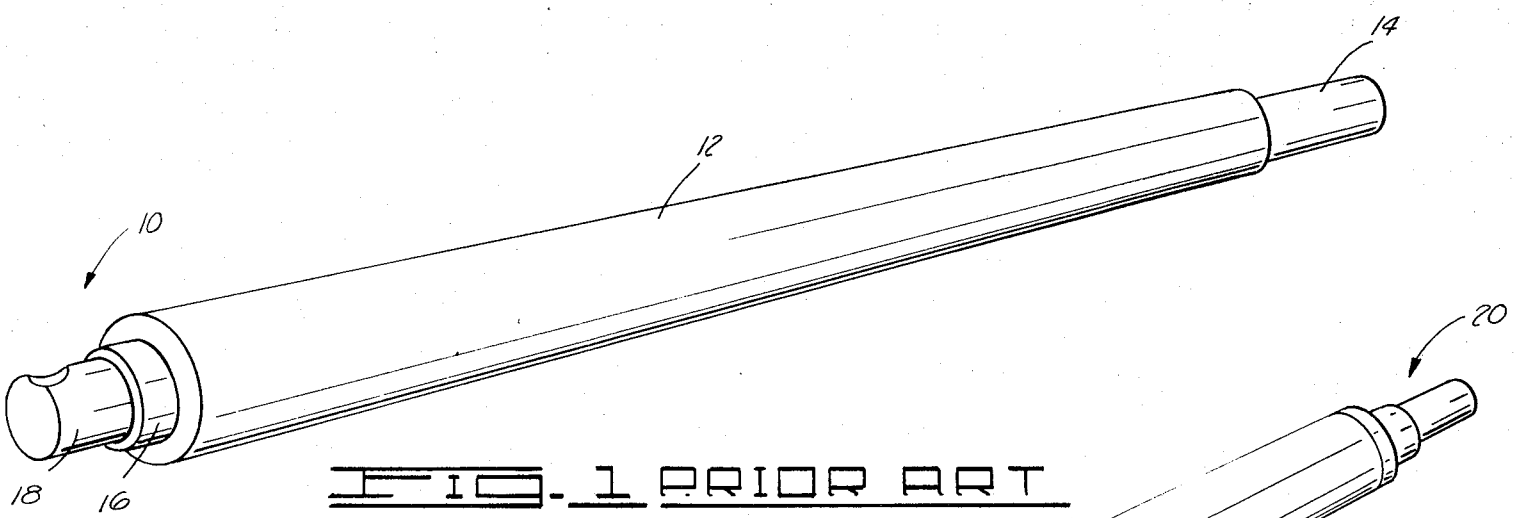
FIG. 1 PRIOR ART
FIG. 1 is a perspective view of a prior art film processor roller with an end plug welded in place.

In FIG. 1 a prior art end plug designated by character 10 is shown either cemented or welded in one end of a hollow film processor roller 12. A second plug 14 is also welded or cemented at the opposite end of the processor roller 12. The end plug 10 also shows a bearing surface 16 and 18 which may be used for securing a roller or gear thereon.

Figure 2:
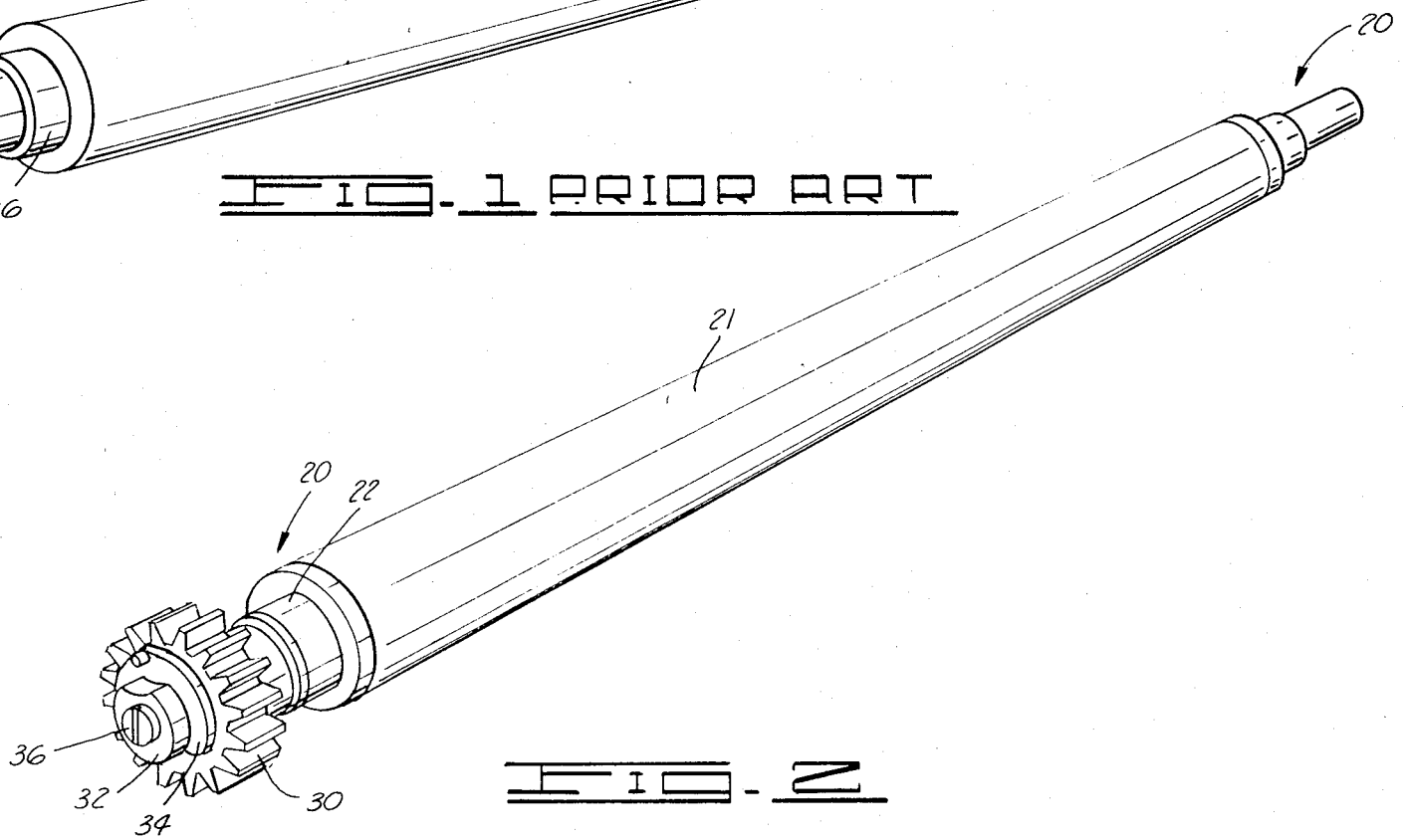
FIG. 2 illustrates a hollow film processor roller with the removable roller end plug received in both ends of the hollow roller with a gear mounted on one of the end plugs.
Figure 3:
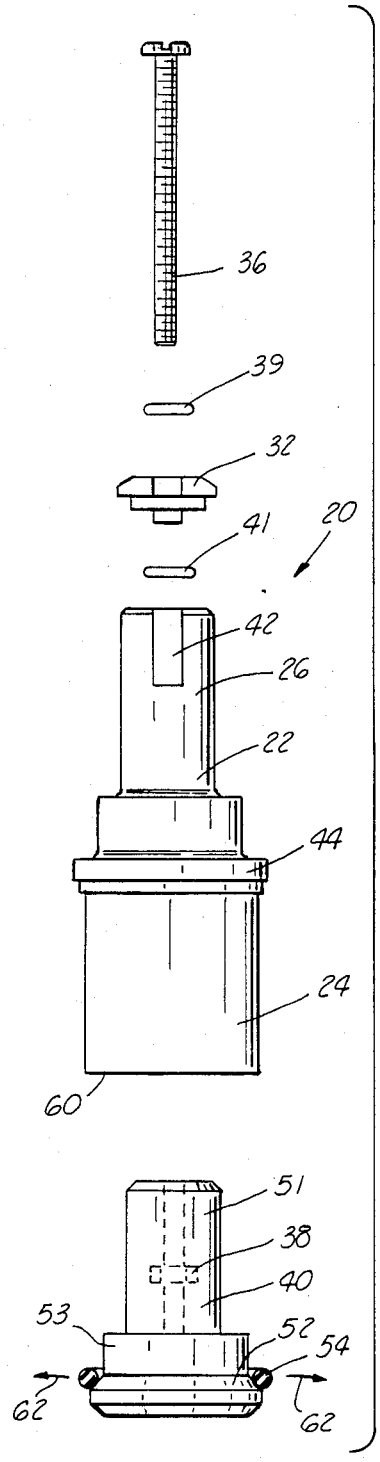
FIG. 3 illustrates an exploded view of the roller end plug.
Figure 4:
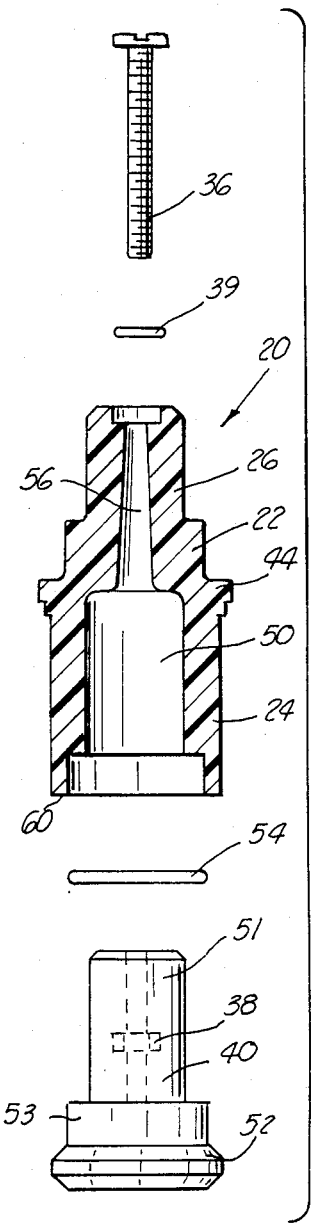
FIG. 4 illustrates an alternative embodiment of the end plug with the plug housing shown in cross section.

In FIG. 2 the improved film processor transport roller end plug is shown and designated by general reference numeral 20. The plug 20 is seen mounted in the opposite ends of a hollow film processor roller 21. The end plug 20 includes a housing 22 having a first end portion 24 and a second end portion 26 shown in FIGS. 3 and 4. The second end portion 26 may be used as a bearing surface for receiving a removable gear 30 which is secued thereto by a cap 32, a snap ring 34 and a threaded screw 36 which is received through the housing 22 for engaging a nut 38 mounted inside a core 40. The nut 38 and core 40 are shown in FIG. 3 and FIG. 4. The cap 32 and screw 36 are sealed using "O" rings 39 and 41.

In FIG. 3 the film processor hollow end plug 20 can be seen in an exploded view. In this view the housing can be seen having a key slot 42 in the second end portion 26 for securing the gear 30 thereon.

The first end portion 24 is dimensioned so its outer circumference is adapted for receipt against the inner circumference of the hollow film processor roller 21. Dividing the first end portion 24 and the second end portion 26 is a land 44 which engages the edge of the processor roller 21.

Referring now to FIG. 4 the housing 22 can be seen in cross section having a cavity 50 for receiving one end 51 of the core 40 therein. The other end 53 of the core 40 includes a cam surface 52 which is used for receiving an "O" ring 54 therearound.

In operation when the "O" ring 54 is placed adjacent to the cam surface 52 with the one end 51 of the core 40 received inside the cavity 50 of the housing 22, the threaded screw 36 is received through a bore 56 inside the housing 22 with the screw 36 engaging the nut 38. The core 40 in then urged upwardly into the cavity 50 of the housing 22. At this time the "O" ring 54 is compressed against the cam surface 52 and against an edge 60 of the first end portion 24 of the housing 22.

As seen in FIG. 3 when this happens the "O" ring 54 is compressed outwardly as shown by arrows 62 thereby engaging the inner circumference of the hollow film processor roller 21. The compressed "O" ring 54 provides a liquid seal and retains the improved film processor roller end plug 20 in place until it is desired to be removed and reused with another film processor roller.

Changes may be made in the construction and arrangement of the parts or elements of the embodiments as described herein without departing from the spirit or scope of the invention defined in the following claims.

What is claimed is:

1. A film processor transport roller end plug for providing a liquid seal in one end of a hollow film processor roller, the plug comprising:

an annular hollow plug housing, the housing having a first end portion and a second end portion, the first end portion having an outer circumference adapted for engaging the inner circumference of the processor roller and receipt therein, the second end portion providing a bearing surface adapted for receiving a gear or the like thereon;

an annular core having one end received in the first end portion of the plug housing, the other end of the core having a cam surface therearound;

an "O" ring received around the cam surface of the core; and a threaded screw received through the plug housing and engaging a threaded nut inside the core, the screw when tightened inside the threaded nut securing the core to the plug housing, the edge of the first end portion of the housing engaging the "O" ring and compressing it against the cam surface and against the inner circumference of the processor roller when the screw is tightened on the threaded nut providing a static seal and securing the plug to the hollow roller.

2. A film processor transport roller end plug for providing a liquid seal in one end of a hollow film processor roller, the plug comprising:

an annular hollow plug housing, the housing having a first end portion and a second end portion, the first end portion having an outer circumference adapted for engaging the inner circumference of the processor roller and receipt therein;

an annular core having one end received in the first end portion of the plug housing, the other end of the core having a cam surface therearound;

an "O" ring received around the cam surface of the core; and a threaded screw received through the plug housing and engaging a threaded nut inside the core, the screw when tightened inside the threaded nut securing the core to the plug housing, the edge of the first end portion of the housing engaging the "O" ring and compressing it against the cam surface and against the inner circumference of the processor roller when the screw is tightened on the threaded nut providing a static seal and securing the plug to the hollow roller.

3. The hollow end plug as described in claim 2 wherein the second end portion of the housing is a bearing surface for receiving a gear or the like thereon.

* * * * *